US005833498A

United States Patent [19]

Smyk

[11] Patent Number: 5,833,498

[45] **Date of Patent: *Nov. 10, 1998**

[54] ELECTRICAL CONNECTOR HAVING IMPROVED RETENTION FEATURE AND RECEPTACLE FOR USE THEREIN

[75] Inventor: Michael C. Smyk, Mechanicsburg, Pa.

[73] Assignee: Berg Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 566,293

[22] Filed: Dec. 28, 1995

[51] Int. Cl.[6] ..... H01R 23/02

[52] U.S. Cl. ..... 439/682; 439/82

[58] Field of Search ..... 439/660, 682, 439/856, 857, 851, 861, 862, 836, 70

[56] References Cited

U.S. PATENT DOCUMENTS

| | | | |
|---|---|---|---|
| 2,762,026 | 9/1956 | Knohl | 439/682 |
| 4,533,188 | 8/1985 | Miniet . | |
| 4,555,154 | 11/1985 | Sugars . | |
| 4,607,907 | 8/1986 | Bogursky | 439/682 |
| 4,778,396 | 10/1988 | Spooren | 439/682 |
| 4,863,402 | 9/1989 | Black et al. | 439/682 |
| 4,986,772 | 1/1991 | Fukutani | 439/892 |
| 4,992,057 | 2/1991 | Smit | 439/83 |
| 5,022,870 | 6/1991 | Sakamoto et al. | 439/608 |
| 5,169,347 | 12/1992 | Sang | 439/885 |
| 5,334,053 | 8/1994 | Noschese | 439/682 |
| 5,354,219 | 10/1994 | Wanjura | 439/608 |

*Primary Examiner*—Hien Vu

*Attorney, Agent, or Firm*—Daniel J. Long; M. Richard Page

[57] ABSTRACT

Disclosed is a receptacle for an electrical connector comprising a plurality of conductive terminals at least in part enclosed within a housing and there being a plurality of windows in said housing to allow access to said conductive terminals and said housing being extended to at least partially restrict at least some of said windows.

3 Claims, 10 Drawing Sheets

ELECTRICAL CONNECTOR HAVING IMPROVED RETENTION FEATURE AND RECEPTACLE FOR USE THEREIN

BACKGROUND OF THE INVENTION

1. Field of the Invention

The present invention relates to electrical connectors and, more particularly, to electrical connectors having a receptacle housing with a gripping resilient feature.

2. Brief Description of Prior Developments

In electrical connectors it is desirable that forces required to mate and unmate the receptacle and the header fall within certain upper and lower limits and that such forces remain relatively constant even after the receptacle and the header have been mated and unmated on numerous occasions. In electrical connectors in which the receptacle and header are engaged by means of a resilient interaction between metallic terminal and pin elements, there may be a tendency, because of loss of resiliency, for mating and unmating forces to decrease below desirable limits. It is also found that in such connectors, various degrees of wear occur as a result of the resilient interaction between the metallic terminals and pins. As a result of such wear, gold or other metallic platings may be removed or reduced to unacceptably or undesirably thin levels.

There is, therefore, a need for a retention feature in electrical connectors which maintains a consistent level of mating and unmating force within a desired range of forces and which does not have a tendency to remove gold or other metallic platings from terminals and pins.

SUMMARY OF THE INVENTION

The connector of the present invention includes a receptacle which includes an insulative housing with opposed side walls, end walls and top and bottom walls. The housing is preferably comprised of a resilient insulative material. As is conventional, conductive terminals are positioned within the side and end walls and are axially aligned with windows in the lower engagement surface. Ledges of insulating material extend partially across these windows so that when pins from a header are inserted into the windows to engage the terminals a retention force is applied to the pins by the ledges of the insulative material. It is found, in such a connector, that mating and unmating forces remain surprisingly and unexpectantly uniform even after the mating and unmating cycle is repeated on numerous occasions. It is also found, surprisingly and unexpectantly, that little or no plating is removed from the pins and terminals during mating and unmating.

BRIEF DESCRIPTION OF THE DRAWINGS

The receptacle and electrical connector of the present invention are further described with reference to the accompanying drawings in which.

DETAILED DESCRIPTION OF THE PREFERRED EMBODIMENTS

Figure 1:
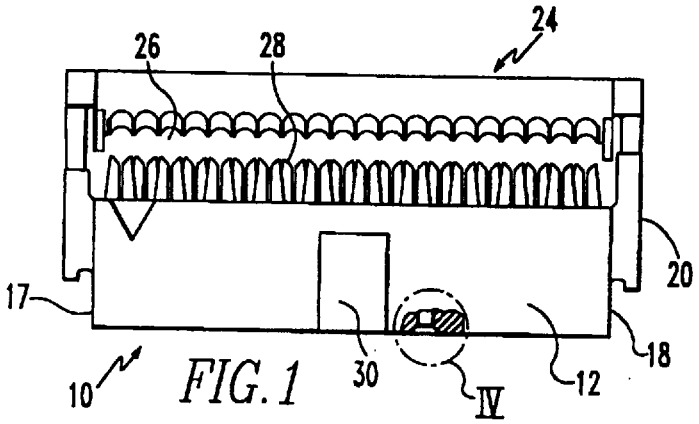
FIG. 1 is a front elevational view of a receptacle of the present invention.
Figure 3:
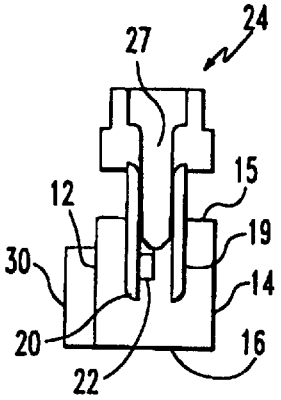
FIG. 3 Is an end view of the receptacle shown in FIG. 1.
Figure 2:
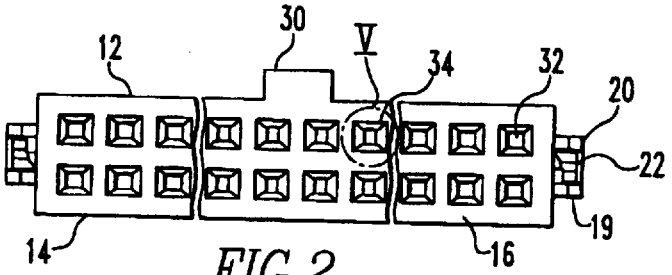
FIG. 2 is a bottom plan view of the receptacle shown in FIG. 1.
Figure 4:
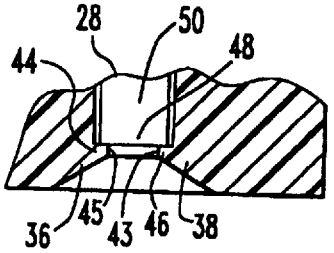
FIG. 4 is a detailed cut away view of the area within circle IV in FIG. 1.
Figure 5:
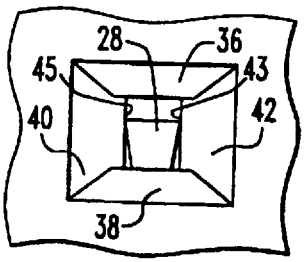
FIG. 5 is a detailed view of the area within circle V in FIG. 2.
Figure 6:
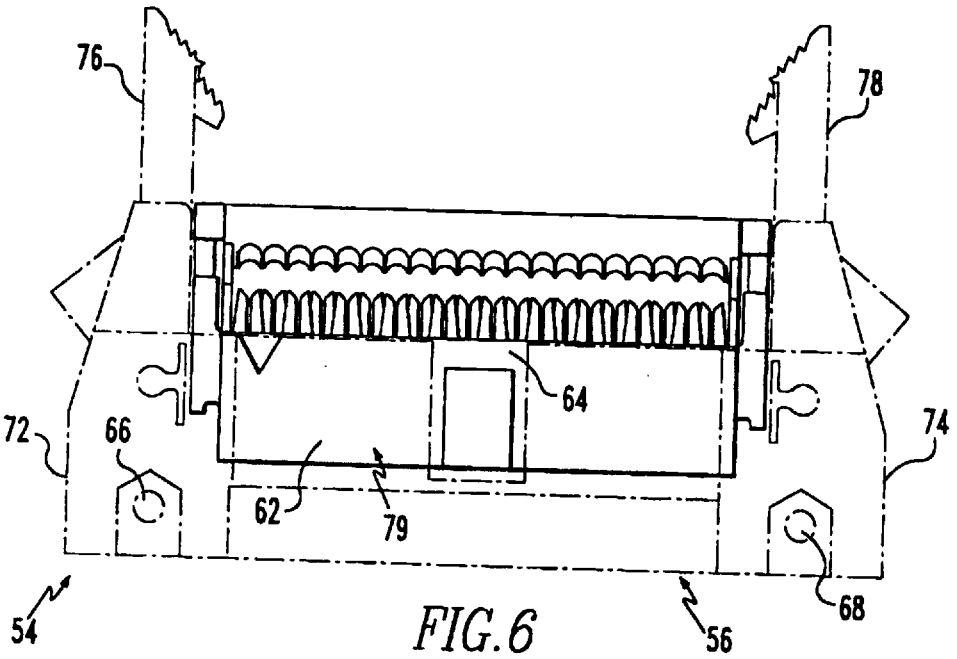
FIG. 6 is a front elevational view of an electrical connector including a receptacle similar to that shown in FIGS. 1–5 mated with a latched header.
Figure 8:
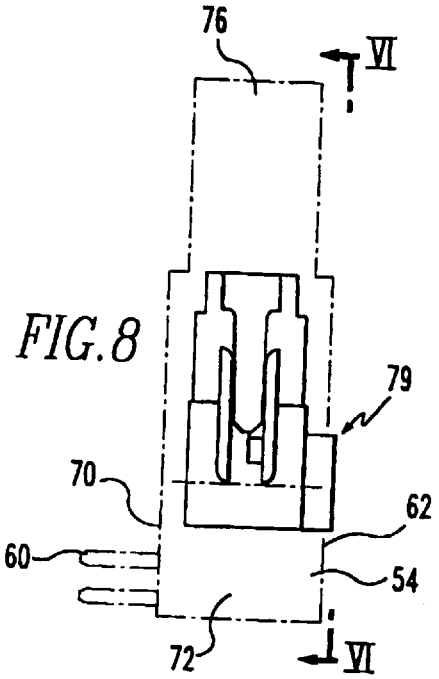
FIG. 8 is an end view of the electrical connector shown in FIG. 6.
Figure 9:
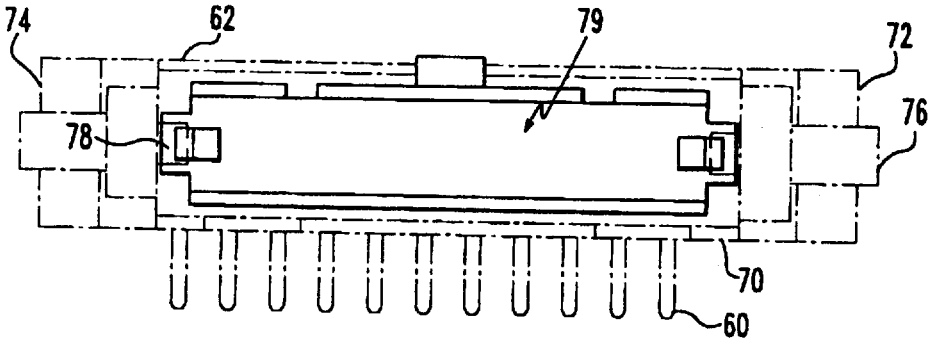
FIG. 9 is a top plan view of the electrical connector shown in FIG. 6.
Figure 7:
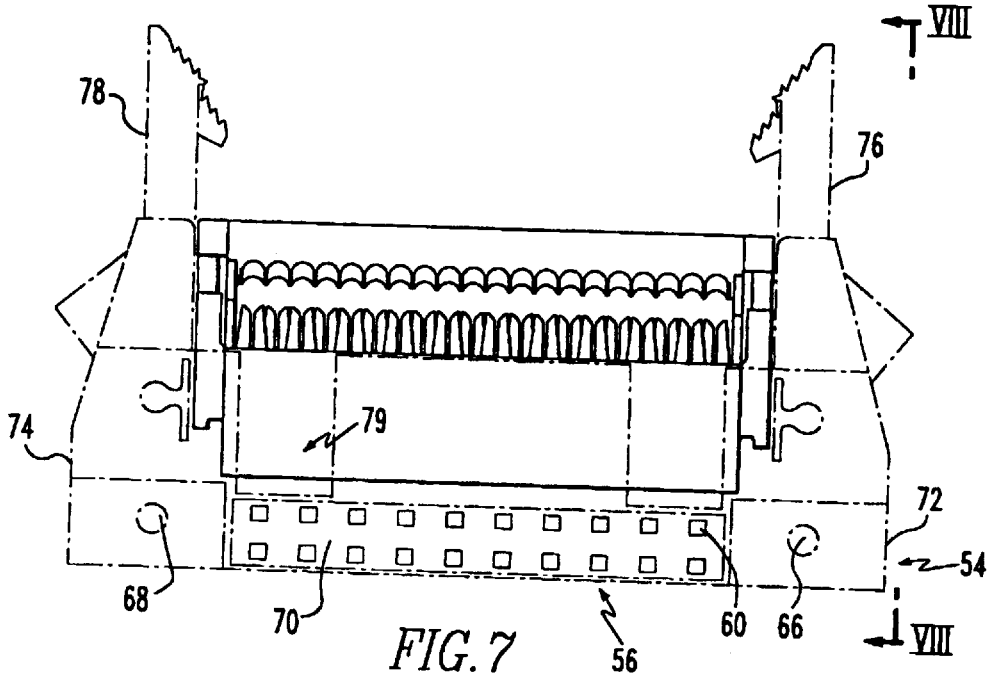
FIG. 7 is a rear elevational view of the electrical connector shown in FIG. 6.

Referring to FIGS. 1–5, the insulating housing of the receptacle is shown generally at numeral 10. This receptacle housing includes a front side wall 12, a rear sidewall 14, and upper engagement surface 15 and a lower engagement surface 16 and opposed end walls 17 and 18. On each end wall there are a pair of vertical latch engagement ribs 19 and 20 and a lateral stop as at 22. Superimposed over the upper engagement surface there is a ribbon cable engagement member shown generally at numeral 24 which is spaced from the upper engagement surface by a ribbon cable receiving slot 26 and which are fixed to the vertical latch engagement ribs of the receptacle by vertical latches as at 27. (IDC) terminals as at 28 are positioned between the front and rear side walls and extend upwardly through the upper engagement surface to connect with ribbon cable inserted into the ribbon cable receiving slot. On the front wall there is a vertical keying projection 30. On the lower engagement surface there are a plurality of unrestricted windows as at 32 through which pins from a mating header (not shown) pass. There are also a plurality of restricted windows as at 34 which also receive pins from the mating header. Each of these windows is surrounded by a first pair and a second pair and inwardly sloping sides 36 and 38 and 40 and 42, respectively. Sides 40 and 42 have, respectively, inwardly projecting ledges 43 and 44 having terminal edges, respectively, at 45 and 46 extending into the window so as to produce a restricted vertical passageway as at 48 (FIG. 4) which beyond these ledges returns to a widened vertical passageway as at 50 (FIG. 4.) The terminal as at 28 (FIG. 5) is visible through the window. The ledges would preferably restrict the width of the window to a width which is about 4% to about 6% less than the width or diameter of the pin which is received n the window. The edges would also have a thickness (in the vertical direction as shown in FIG. 4) of from about 0.015 inch to about 0.025 inch.

Figure 10:
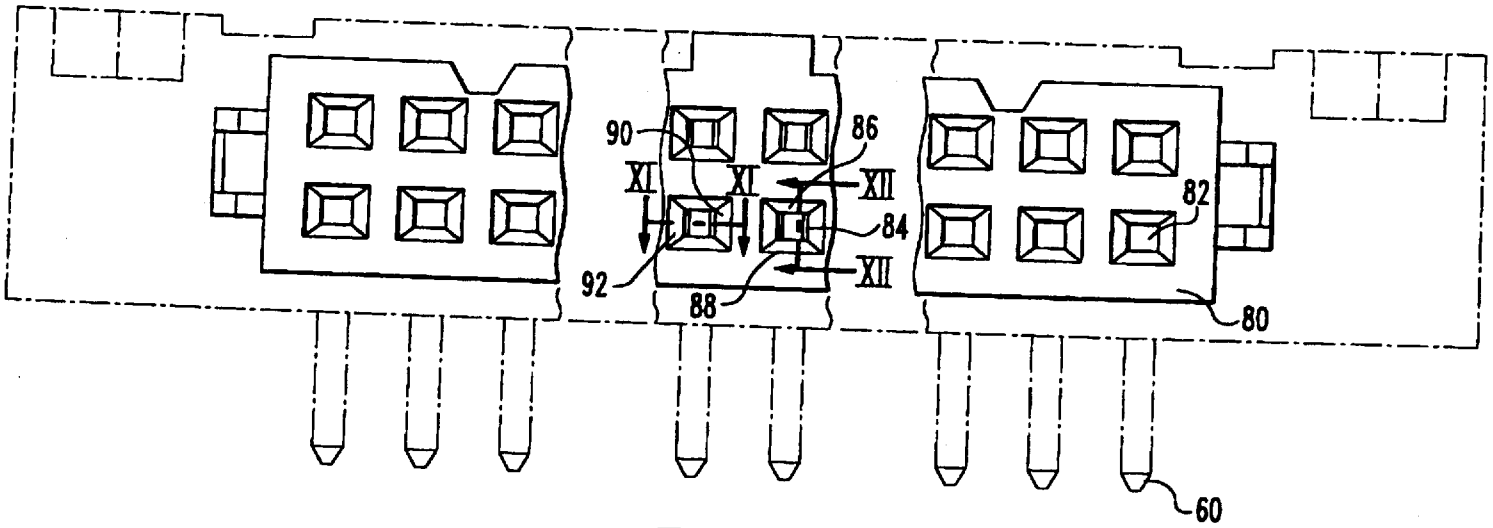
FIG. 10 is a cross sectional view through X—X in FIG. 6.
Figure 11:
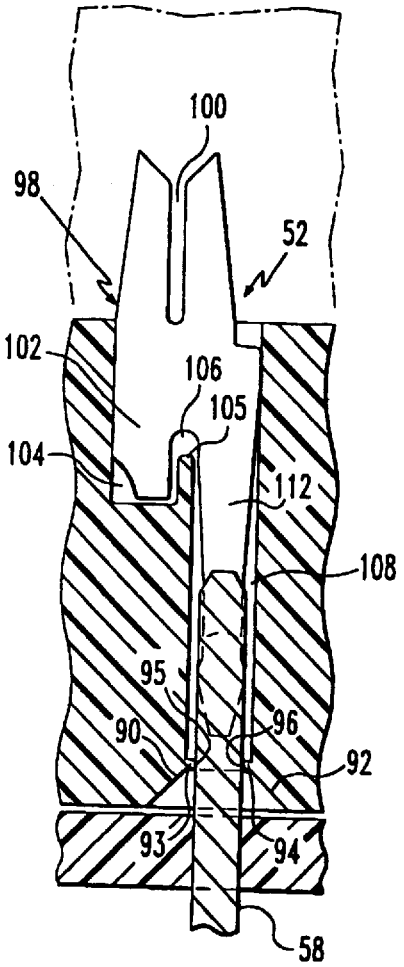
FIG. 11 is a cross sectional view through XI—XI in FIG. 10.
Figure 12:
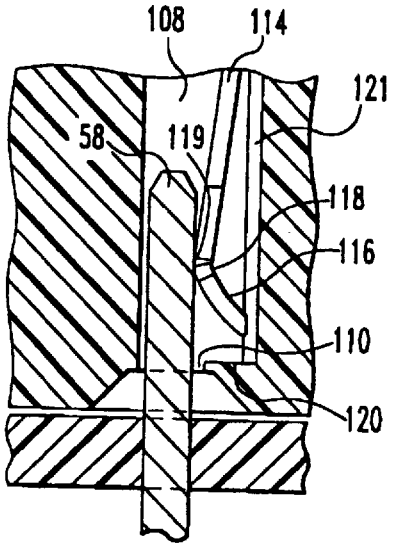
FIG. 12 is a cross sectional view through XII—XII in FIG. 10.

Referring to FIGS. 6–12, a connector employing a receptacle as described above will include a header shown generally at numeral 54. Such a header includes a base member 56 with a plurality of pins, each of which includes an upper section as at 58 (FIGS. 11–12) and a lower perpendicular section at 60. Extending upwardly from the base is a front wall 62 which has a key engaging slot 64. Also positioned on the base are mounting apertures as at 66 and 68. In opposed relation to the front wall is rear wall 70 to further surround the position for engagement with receptacles there are end walls 72 and 74 and on these end walls there are, respectively, pivoting latches 76 and 78. A receptacle identical to the one shown in FIGS. 1–6 is shown generally at numeral 79 and is engaged with the header 54. Referring particularly to FIG. 10, it will be seen that on the lower engagement surface 80 of the receptacle there are a plurality of unrestricted windows as at 82 which receive pins from the header and a plurality of restricted windows as at 84 which also receive pins from the mating header. Each of these windows is surrounded by an inwardly sloping first pair of sides 86 and 88 and second pair of sides 90 and 92. Referring particularly to FIGS. 11–12, it will be seen that sides 90 and 92 have respectfully, inwardly projecting ledges 93 and 94 having respectively edges 95 and 96 which extend from sides 90 and 92 by a uniform distance so that edges 95 and 96 are parallel to sides 90 and 92. These ledges also produce a restricted window. It will also be observed from FIGS. 11–12 that each of the terminals as at 52 have an upper insulation displacement section 98 which protrudes from the receptacle and which has a vertical slot 100 for receiving conductors in a ribbon cable. A lateral leg 102 is engaged in a recess 104 in the receptacle housing and a vertical wall 105 in the receptacle housing engages a vertical slot 106 in the terminal. In the receptacle housing there is a bore 108 having a restricted section 110. A lower leg 112 of the terminal extends into this bore. The lower leg has an upper inwardly angled section 114 and a lower outwardly angled section 116 with a medial apex 118 between them, and on the side of the terminal abutting the pin a contact surface 119 is formed. The ledges extend in a direction normal to the plane of this contact surface. When an upper section 58 of a pin from the header is inserted into the window 84 and the bore 108, it bears against the apex 118 of the terminal and causes the lower outwardly angled section of the terminal to move downwardly toward a stop 120 which projects inwardly into the vertical bore from the receptacle housing.

Figure 13:
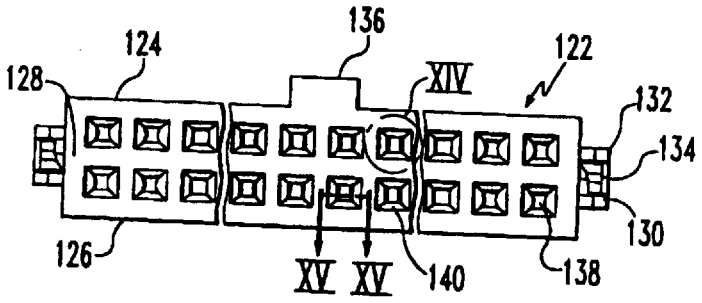
FIG. 13 is a bottom plan view similar to FIG. 2 of a receptacle representing an alternate embodiment of the present invention.
Figure 15:
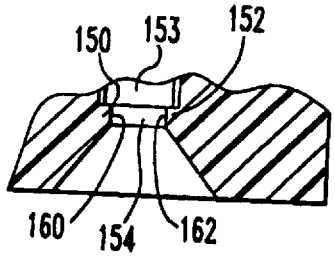
FIG. 15 is a cross sectional view through XV—XV in FIG. 14.
Figure 14:
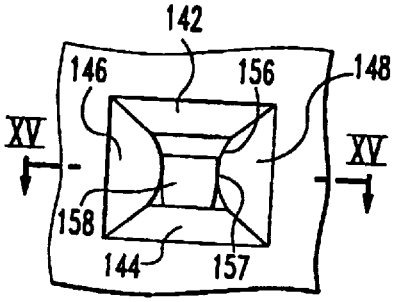
FIG. 14 is a detailed view of the area within circle XIV in FIG. 13.
Figure 16:
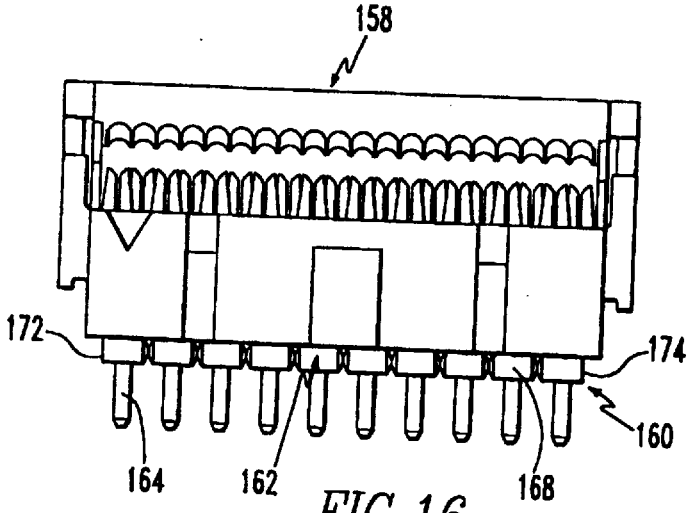
FIG. 16 is a front elevational view of an electrical connector including a receptacle similar to that shown in FIGS. 1–5 mated with a header without latches.
Figure 17:
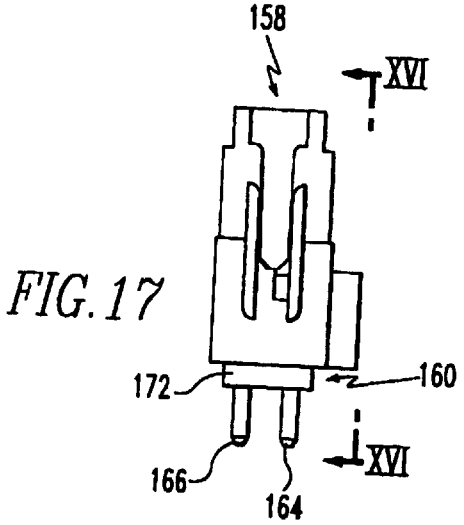
FIG. 17 is a rear elevational view of the electrical connector shown in FIG. 16.
Figure 18:
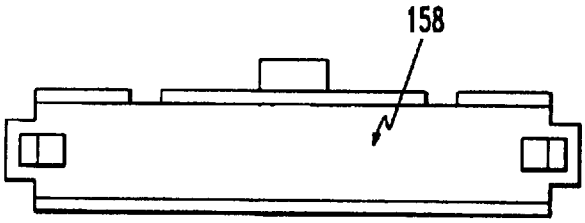
FIG. 18 is an end view of the electrical connector shown in FIG. 16.
Figure 19:
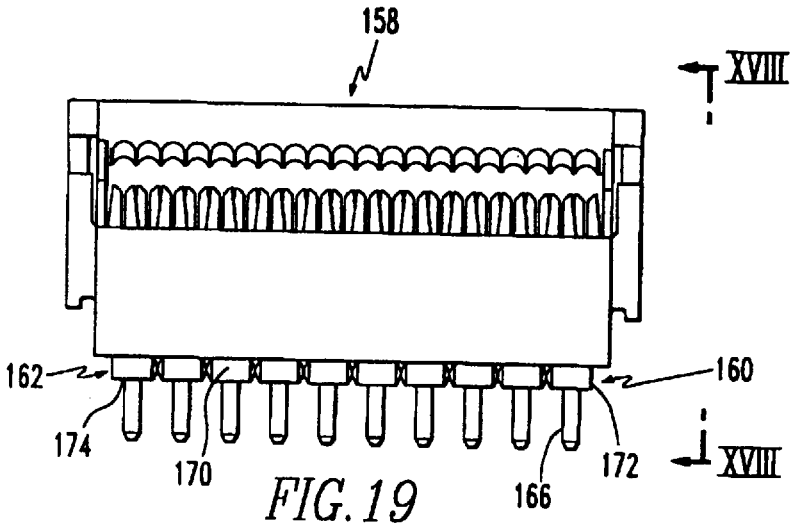
FIG. 19 top plan view of the electrical connector shown in FIG. 16.

Referring to FIGS. 13–15, another embodiment is shown. In this embodiment the insulative housing of the receptacle is shown generally at numeral 122. Like the other embodiments, this receptacle housing includes a front side wall 124, a rear sidewall 126, an upper engagement surface (not shown) and a lower engagement surface 128. On each end wall there are vertical latch engagement ridges as at 130 and 132 with a lateral stop 134. Like the other embodiments, superimposed over the upper engagement surface there is a ribbon cable engagement member (not shown) which is spaced from the upper engagement surface by a ribbon cable receiving slot (not shown) through the upper engagement surface to connect with ribbon cable inserted into the ribbon cable receiving slot. On the front wall there is a vertical keying projection 136. On the lower engagement surface there are a plurality of unrestricted windows as at 138 through which pins from a mating header pass. There are also a plurality of restricted windows as at 140 which also receive pins from a mating header. Each of these windows is surrounded by a first pair of inwardly sloping sides 142 and 144 and a second pair of inwardly sloping sides 146 and 148. Sides 146 and 148 have, respectively, projecting ledges 150 and 152 extending into the window so as to produce a restricted section as at 154 (FIG. 15) of a vertical bore 155 (FIG. 14). It will be noted that these ledges have a curved edge as at 156 and that they have a medial area 157 at which they extend into the window further than at their ends. A terminal as at 158 (FIG. 14) is also visible through the window. It will also be noted that ledges 150 and 152 extend into the windows by smaller amounts at their ends and by greater amounts medially so that they have, respectively, curved edges 160 and 162.

It will also be appreciated that in addition to a latched header as is shown in FIGS. 6–12, the receptacle of this invention is also useful with an unlatched header. Referring to FIGS. 16–19, a connector employing a receptacle 158 as described above will include a header shown generally at numeral 160. Such a header includes a base member generally at numeral 162 with a plurality of pins, each of which includes an upper vertical section (not shown) and a lower vertical section at 164 and 166. The base includes a front wall 168, a rear wall 170 and end walls 172 and 174. In this connector, on the lower engagement surface of the receptacle there are a plurality of unrestricted windows which receive pins from the header and a plurality of restricted windows which also receive pins from a mating header in the same way as was shown in FIGS. 10–12. Also in the same way shown in FIG. 10–12, each of these windows is surrounded by an inwardly sloping first pair of sides and second pair of sides which have respectfully, inwardly projecting ledges having respectively ledges which extend from sides by a uniform distance so that edges are parallel to the sides. These ledges also produce a restricted window. In the same way as was shown in FIGS. 11–12, each of the terminals have an upper section which protrudes from the receptacle which has a vertical slot for engaging ribbon cable. A lateral leg is engaged in a recess in the receptacle housing and a vertical wall in the receptacle housing engages a vertical slot in the terminal. In the receptacle housing there is a vertical bore having a restricted section, and a lower leg of the terminal extends downwardly into this vertical bore. The lower leg has an upper inwardly angled section and a lower outwardly angled section with there being a medial apex between them. When an upper section of a pin from the header is inserted into the window and the vertical aperture, it bears against the apex of the terminal and causes the lower outwardly angled section of the terminal to move downwardly toward a stop which projects inwardly into the vertical bore from the receptacle housing. As was shown in FIG. 12, a groove extends vertically in the bore.

Comparative Test

Figure 20:
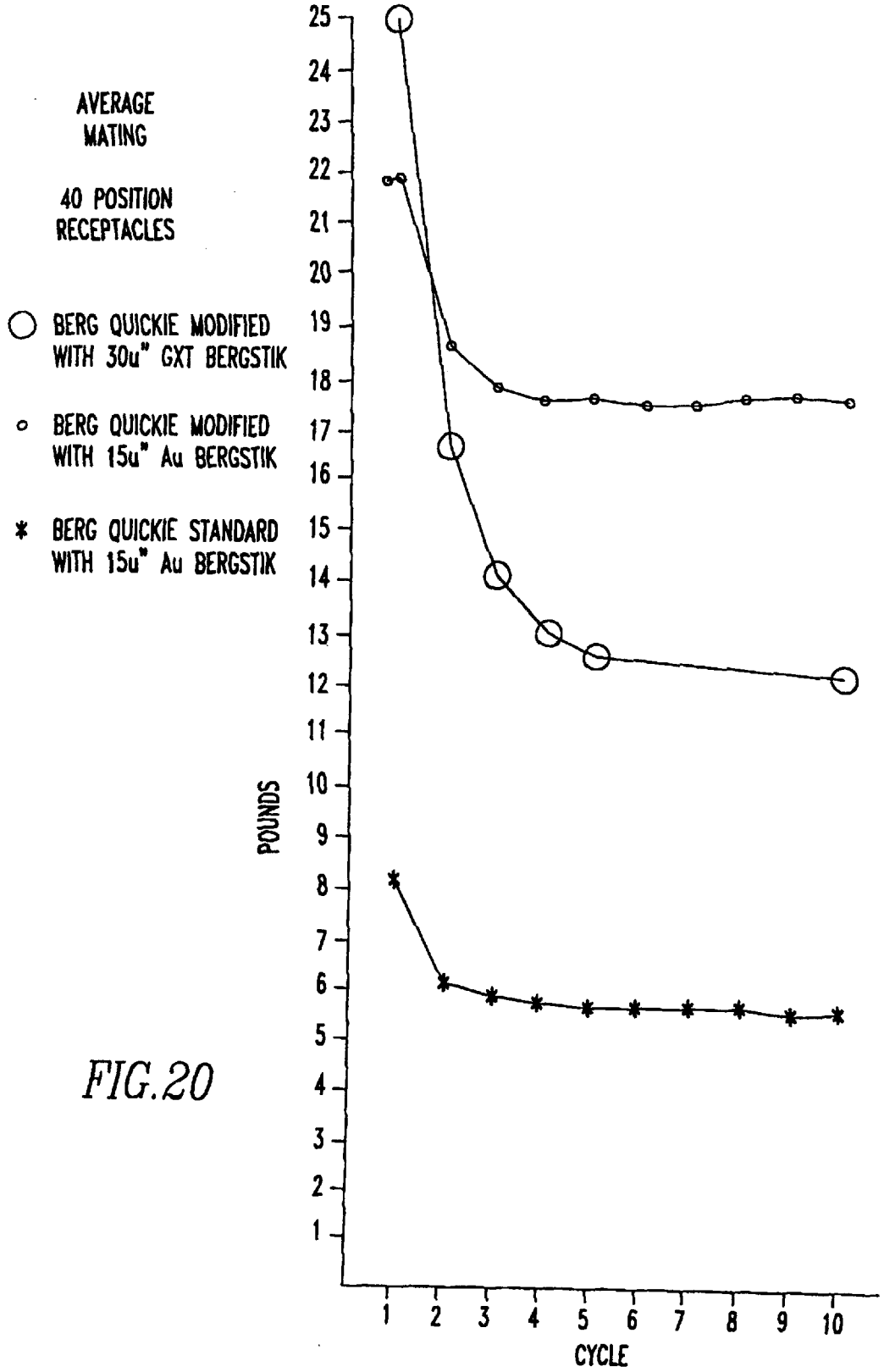
FIG. 20 is a graph showing the results of tests comparing average mating force for connectors made according to the present invention with a number of conventional connectors.
Figure 21:
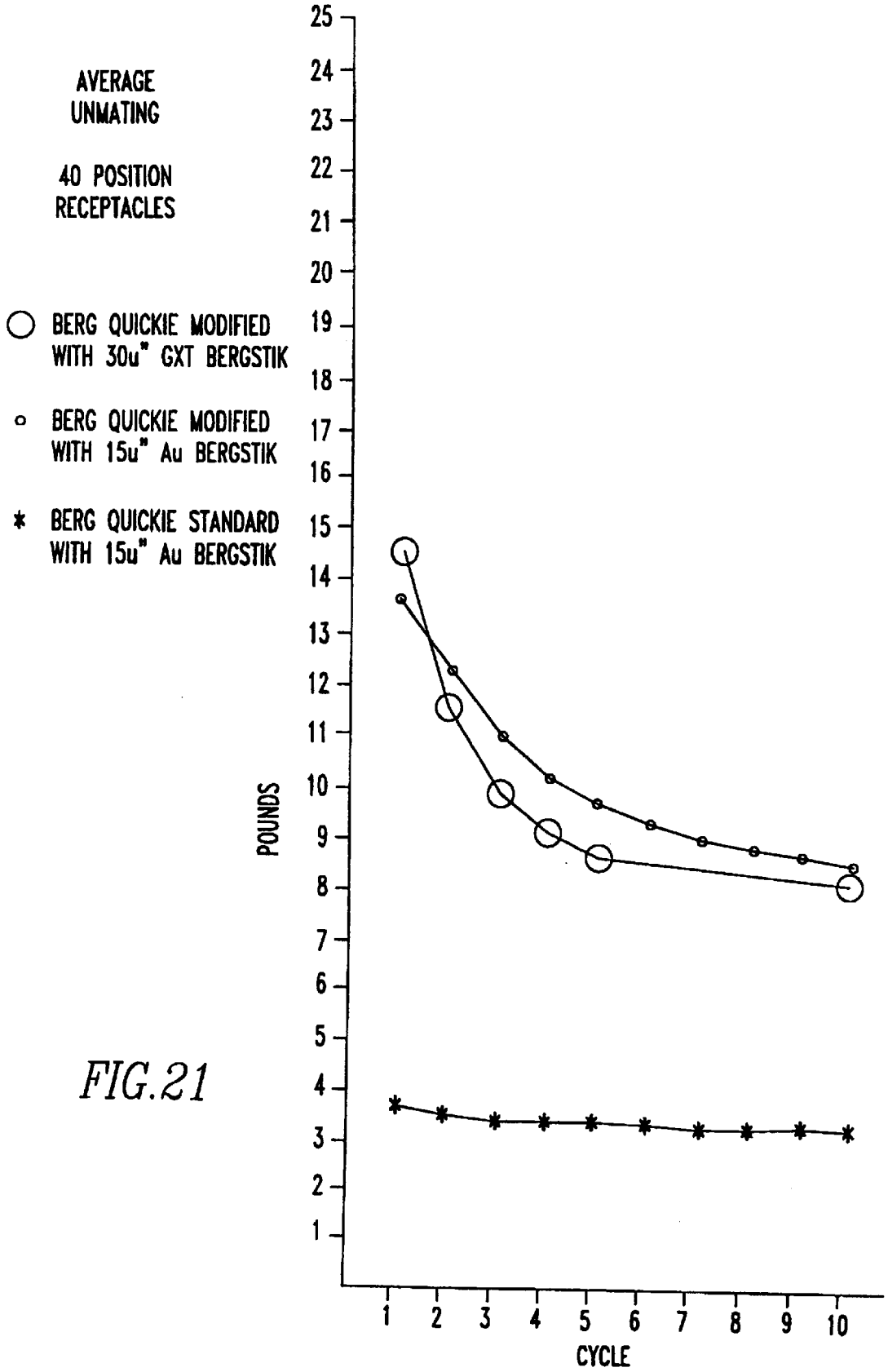
FIG. 21 is a graph showing the results of tests comparing average unmating force of connectors made according to the present invention with various conventional connectors.

Comparative tests were conducted with a number of 40 position receptacles. In this test the performance of two QUICKIE receptacles manufactured by Berg Electronics, Inc. of St. Louis, Mo. which were modified in accordance with this invention were compared with an unmodified QUICKIE receptacle (part no. 71601). The two modified headers were both QUICKIE receptacles with 15$\mu$ inch gold plating (part no. 95208 as modified). Modification was accomplished generally in the manner illustrated in FIGS. 1–5 by restricting 8 of the 40 windows by means of two plastic ledges per restricted window. Each of these ledges had a thickness (in the vertical direction when positioned as shown in FIG. 4) if 0.020 inch and into the restricted window to reduce their widths from 0.030 inch to an average of 0.0237 inch while lengths of the restricted windows received 0.030 inch. The lengths and widths of the unrestricted windows were both 0.030 inch. The unmodified receptacle was standard QUICKIE receptacle with 15$\mu$ inch gold plating (part no. 71601) which had unrestricted windows having both a width and length of 0.030 inch. The insulative housing and the ledges were composed of 30% by weight fiberglass reinforced polyester (DUPONT RYNITE). The first modified receptacle was mated with a BERGSTIK header also manufactured by Berg Electronics, Inc. having 30$\mu$ inch GXT™ TM plating and 0.025 inch square pins (part no. 92604). The second modified receptacle was mated with a BERGSTIK header having a 15$\mu$ inch gold plated 0.025 inch square pins (part no. 98001) The unmodified receptacle was also mated with a 15$\mu$ inch gold plated, 0.025 in square pins BERGSTIK header (part no. 68001). Mating and unmating of these modified receptacles was carried out in ten successive cycles. The amount of force required to carry out such mating and unmating was measured and is shown respectively in FIGS. 20 and 21. The average mating and unmating force for the conventional receptacles is also shown respectively in FIGS. 20 and 21. As will be seen from FIGS. 20 and 21, surprising and unexpected increases in mating and unmating forces were achieved using the modified receptacles.

It will be appreciated that a receptacle and a electrical connector using such a connector has been described which allows mating and unmating force to be maintained at a relatively uniform level within a desired range even after numerous mating and unmating cycles. It will also be appreciated that this receptacle also will minimize removal of plating on abutting terminal and pin surfaces. It will also be appreciated that the above stated advantages may be achieved by a relatively easily manufactured and cost effective means.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising:

(a) a receptacle for an electrical connector comprising:

(i) a reinforced polyester insulative housing comprising generally parallel opposed side walls and generally parallel opposed end walls all interposed between generally parallel upper and lower walls having upper and lower engagement surfaces and there being a plurality of pin receiving windows having lateral sides in one of said upper or lower engagement surfaces;

(ii) a plurality of conductive terminals, wherein each of said terminals has opposed ends and has a single inwardly angled leg at one end and a slot at the other end for receiving a cable, and each of said terminals is positioned within said side and end walls and is axially aligned with one of said plurality of pin receiving windows; and (iii) ledges extending substantially perpendicularly inwardly from the lateral sides of at least some of the pin receiving windows for restricting at least some of said pin receiving windows; and (b) a header comprising a base and a plurality of conductive pins wherein said header is positioned so that said conductive pins pass through the pin receiving windows in the receptacle to engage said conductive terminals, wherein each single inwardly angled leg has a contact surface thereon where each of said contact surfaces abuts one of said pins and each of the ledges for restricting at least one of said pin receiving windows is in a plane perpendicular to said contact surface and each of the restricted windows has a width and each of the pins has a width and said restricted window widths are about 4% to about 6% less than said pin widths and the ledges each have a vertical thickness and each of said thicknesses is from about 0.015 inch to about 0.025 inch.

2. The connector of claims 1 wherein the reinforced polyester is a fiberglass reinforced polyester.

3. The connector of claim 2 wherein the reinforced polyester is about 30% by weight fiberglass.

* * * * *